US012220064B2

(12) United States Patent
He et al.

(10) Patent No.: US 12,220,064 B2
(45) Date of Patent: Feb. 11, 2025

(54) FOLDING SEAT

(71) Applicant: SHENZHEN THOUSANDSHORES TECHNOLOGY CO., LTD., Guangdong (CN)

(72) Inventors: Ding He, Guangdong (CN); Zhi Liu, Guangdong (CN)

(73) Assignee: SHENZHEN THOUSANDSHORES TECHNOLOGY CO., LTD., Shenzhen (CN)

( * ) Notice: Subject to any disclaimer, the term of this patent is extended or adjusted under 35 U.S.C. 154(b) by 95 days.

(21) Appl. No.: 18/112,815

(22) Filed: Feb. 22, 2023

(65) Prior Publication Data

US 2024/0108140 A1 Apr. 4, 2024

(30) Foreign Application Priority Data

Sep. 29, 2022 (CN) ..... 202222601015.6

(51) Int. Cl.
*A47C 4/30* (2006.01)
*A47C 4/02* (2006.01)
*A47C 4/44* (2006.01)

(52) U.S. Cl.
CPC ..... *A47C 4/30* (2013.01); *A47C 4/02* (2013.01); *A47C 4/44* (2013.01)

(58) Field of Classification Search
CPC .. A47C 4/48; A47C 4/44; A47C 4/025; A47C 4/34; A47C 4/02
USPC ..... 297/56, 16.1, 45, 16.2
See application file for complete search history.

(56) References Cited

U.S. PATENT DOCUMENTS 1,209,679 A * 12/1916 Decker ..... A47C 19/126 108/118
3,138,400 A * 6/1964 Reid ..... A47C 4/50 297/363
3,754,786 A * 8/1973 Boucher ..... A47D 13/043 248/164
5,851,052 A * 12/1998 Gustafsson ..... A47C 4/286 297/16.2
9,033,410 B2 * 5/2015 Roani ..... A47C 1/14 297/16.1
11,547,214 B2 * 1/2023 Smit ..... A47C 4/50

* cited by examiner

*Primary Examiner* — Milton Nelson, Jr.
(74) *Attorney, Agent, or Firm* — Porus IP LLC

(57) ABSTRACT

Disclosed is a folding seat which comprises a chair pocket, a first supporting assembly, and a second supporting assembly, the chair pocket is sheathed on the first supporting assembly and the second supporting assembly. The first supporting assembly comprises a supporting rod and a supporting base, the supporting rod is hinged in the supporting base and rotates in a preset range. The second supporting assembly and the first supporting assembly have the same structure and arranged opposite to each other detachably. By arranging the first supporting assembly and the second supporting assembly detachably to support the chair pocket, the folding seat can be fixed. By dissembling the first supporting assembly and the second supporting assembly, then rotating and adjusting the supporting rods in the first supporting assembly and the second supporting assembly, the folding seat can be folded and stored.

8 Claims, 6 Drawing Sheets

FOLDING SEAT

CROSS-REFERENCES TO RELATED APPLICATIONS

The present application claims priority to Chinese Patent Application No. 202222601015.6, filed on Sep. 29, 2022, the content of all of which is incorporated herein by reference.

FIELD OF THE INVENTION

The present application generally relates to a folding seat, and more particularly, relates to a folding seat convenient to fold and store.

BACKGROUND

A folding seat is generally composed by a flexible chair surface and a support, for example, the granted patent application CN216961941 U discloses a folding chair, its structure is set up with the same structure of the folding seat commonly used in the market, when storing it, people need to disassemble all the parts of the folding seat to reduce the space occupation.

In the prior art, when storing the folding seat, the folding seat needs to be dissembled, and the process requires people to dissemble all the supporting rods and connection bases, which makes the process of storing and assembling extremely troublesome, and costs a lot of time.

Therefore, the current technology needs to be improved and developed.

BRIEF SUMMARY OF THE DISCLOSURE

According to the defects in the prior art that the folding seat needs to be disassembled when storing, and the process requires people to dissemble all the supporting rods and the connection bases, which causes the process of storing and assembling extremely troublesome, and costs a lot of time, the present application provides a folding seat convenient to fold and store.

The technical solution of the present application to solve the technical problems is as follows:

A folding seat is provided, which comprises:

a chair pocket;

a first supporting assembly which comprises a supporting base and a supporting rod, the supporting rod is hinged to an interior of the supporting base and rotates in a preset range;

a second supporting assembly which has a same structure as the first supporting assembly, and is arranged opposite of the first supporting assembly, the second supporting assembly is detachably connected with the first supporting assembly, and the chair pocket is sheathed on the first supporting assembly and the second supporting assembly.

In the folding seat, one end of the supporting base has a first mounting hole arranged, a foot rod is detachably sheathed in the first mounting hole, the foot rod corresponds to a lower end of the supporting rod, and when the supporting rod is rotated to a storage state, the supporting rod abuts against the foot rod.

In the folding seat, an end position of the lower end of the foot rod and an end position of the lower end of the supporting rod corresponding to each other have a foot sheath arranged respectively, the foot sheath is connected fixedly with the foot rod and the supporting rod respectively, and a side of the foot sheath deviating from the supporting rod or the foot rod is hemispherical.

In the folding seat, another end of the supporting base has a second mounting hole arranged, an arm rod is detachably sheathed in the second mounting hole, the arm rod corresponds to an upper end of the supporting rod, and the arm rod and the foot rod are arranged along a same direction.

In the folding seat, an end position of the upper end of the arm rod and an end position of the upper end of the supporting rod corresponding to each other has a telescopic rod arranged respectively, the telescopic rod is slidably connected with the arm rod and the supporting rod in a sheathing mode respectively, and the telescopic rod is elastically clamped and fixed.

In the folding seat, the supporting base has a limiting groove hole arranged, the limiting groove hole penetrates through two ends of the supporting base, and the first supporting rod is hinged to a central part of the limiting groove hole.

In the folding seat, two sides of the supporting base corresponding to the limiting groove hole have a first limiting part and a second limiting part arranged respectively, and the first limiting part and the second limiting part are configured to limit a rotating range of the supporting rod.

In the folding seat, wherein a middle transverse pipe is arranged between the first supporting assembly and the second supporting assembly;

the supporting base has a pipe sheath arranged, and two ends of the middle transverse pipe are detachably arranged in the pipe sheath of the supporting base in the first supporting assembly and the second supporting assembly respectively;

the supporting base has a clamping base arranged, an inner shape of the clamping base matches with a cross-sectional shape of the middle transverse pipe, and the clamping base is configured to fix the middle transverse pipe having been disassembled.

In the folding seat, the supporting base has a strap arranged, and the strap is configured to fix the first supporting assembly and the second supporting assembly having been stored.

An advantage of the present application is: by arranging the first supporting assembly and the second supporting assembly which are detachable to support the chair pocket to achieve the fixation of the folding seat; when the folding seat needs to be stored, after disassembling the first supporting assembly and the second supporting assembly, the supporting rods in the first supporting assembly and the second supporting assembly respectively can be adjusted by rotation to achieve folding and storing. Comparing with the prior art, the time for storing or assembling can be simplified, and users' operation can be facilitated.

Figure 1:
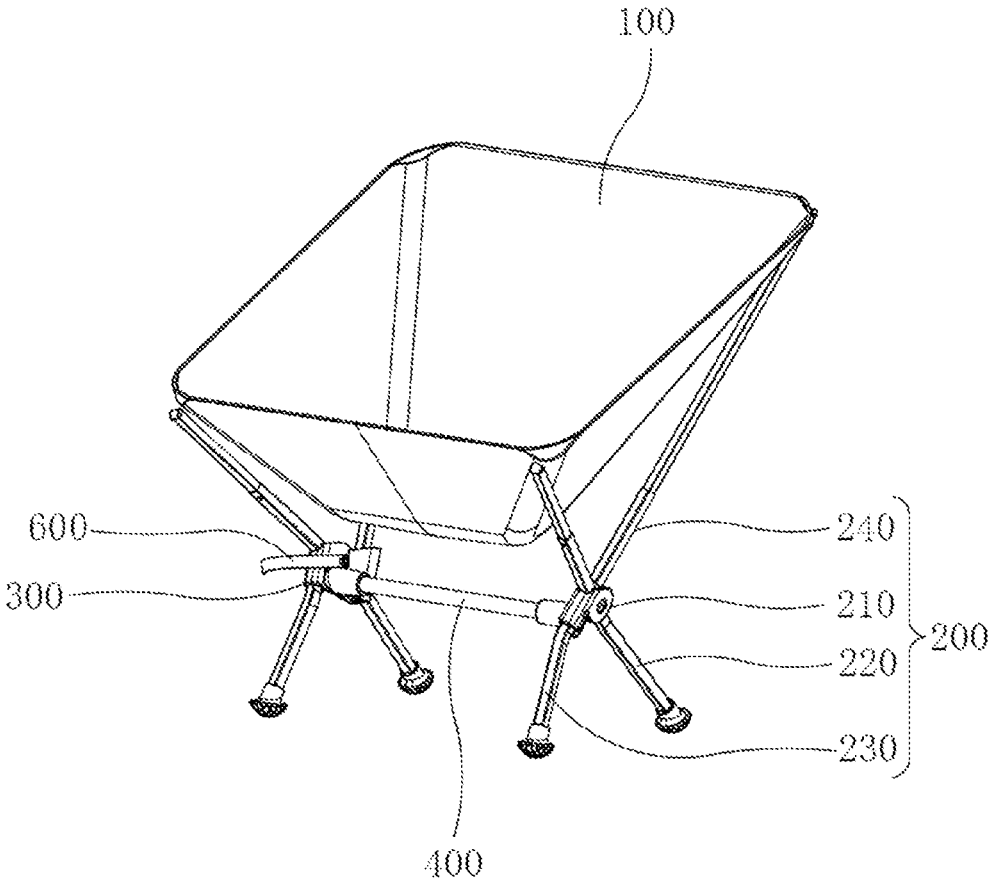
FIG. 1 illustrates a three-dimensional structural schematic diagram on a front view of the folding seat convenient to fold and store disclosed by the present application.

100—chair pocket; 200—first supporting assembly; 210—supporting base; 211—limiting groove hole; 212—pipe sheath; 213—first mounting hole; 214—second mounting hole; 215—first limiting part; 216—second limiting part; 220—supporting rod; 221—telescopic rod; 230—foot rod; 231—foot sheath; 240—arm rod; 300—second supporting assembly; 400—middle transverse pipe; 500—clamping base; 600—strap.

DETAILED DESCRIPTION OF EMBODIMENTS

In order to make the purpose, technical solution and the advantages of the present application clearer and more explicit, further detailed descriptions of the present application are stated herein, referencing to the attached drawings and some embodiments of the present application. It should be understood that the detailed embodiments of the application described here are used to explain the present application only, instead of limiting the present application.

It should be noted that, if an embodiment of the present application relate to a directional indication (including upper, lower, left, right, front, and back . . . ), as a result, the directional indication is applied only to interpreting a relative positional relationship, a motion situation, and more, between each component under a certain specific attitude (as shown in the drawings); if the specific situation changes, the directional indication also changes accordingly.

In addition, if the embodiments of the present application relate to descriptions such as "first" and "second", the descriptions of "first", "second" and more are used for descriptive purposes only, instead of being understood as indicating or implying their relative importance or implicitly indicating the number of an indicated technical feature. Thus, a feature defined with "first" and "second" may explicitly or implicitly indicate comprising at least one of the features. In addition, the technical solutions between various embodiments may be combined with each other, but must be based on being able to be realized by a technical personnel of ordinary skills in the art, and when a combination of the technical solutions is contradictory or cannot be realized, it should be considered that the combination of the technical solutions neither exist, nor within the protection range claimed by the present application.

In the prior art, when storing the folding seat, the folding seat needs to be dissembled, and the process requires people to dissemble all the supporting rods 220 and connection bases, which makes the process of storing and assembling extremely troublesome, and costs a lot of time.

Based on the problem stated above in the prior art, the present application provides a folding seat convenient to fold and store, shown as FIG. 1, the folding seat convenient to fold and store comprises a chair pocket 100; a first supporting assembly 200, the first supporting assembly 200 comprises a supporting base 210 and a supporting rod 220, the supporting rod 220 is hinged to the interior of the supporting base 210 and can rotate in a preset range; a second supporting assembly 300, the second supporting assembly 300 has the same structure as the first supporting assembly 200 and is arranged opposite of the first supporting assembly 200, the second supporting assembly 300 is detachably connected with the first supporting assembly 200, and the chair pocket 100 is sheathed on the first supporting assembly 200 and the second supporting assembly 300.

The present application arranges the first supporting assembly 200 and the second supporting assembly 300 which are detachable, to support the chair pocket 100 so as to achieve a fixation to the folding seat. When the folding seat needed to be stored, after disassembling the first supporting assembly 200 and the second supporting assembly 300, a rotational adjustment is applied to the supporting rods 220 in the first supporting assembly 200 and the second supporting assembly 300 respectively, so as to achieve folding and storing. Comparing with the prior art, the time for storing or assembling can be simplified, users' operation can be facilitated.

In the embodiment stated above, as shown in FIG. 1, the main body of the folding seat convenient to fold and store disclosed by the present application is composed of the chair pocket 100, the first supporting assembly 200 and the second supporting assembly 300, wherein the first supporting assembly 200 and the second supporting assembly 300 are connected detachably, after assembling the first supporting assembly 200 and the second supporting assembly 300, sheathing the chair pocket 100 on the first supporting assembly 200 and the second supporting assembly 300, so as to achieve a support of the chair pocket 100 through the first supporting assembly 200 and the second supporting assembly 300, which makes a user can sit in the chair pocket 100 in a relatively relaxed posture, so as to provide a comfortable supporting experience to the user.

Specifically, the first supporting assembly 200 and the second supporting assembly 300 stated above have the same structure, and arranged in a mirror symmetry mode, for a convenient description, only a plurality of structural parts of the first supporting assembly 200 are named and a connecting relation thereof is described hereafter, while a plurality of structural parts in the second supporting assembly 300 are adopting a same name as that in the first supporting assembly 200, and a technical personnel skilled in the art can perform a symmetrical arrangement and a structural distinguish by referencing to the content shown in the drawings.

Further, in the embodiment stated above, the first supporting assembly 200 comprises a supporting base 210, a supporting rod 220, and a plurality of other functional rods (will be described in details below). A main structure of the present application to achieve storing is that the supporting base 210 and the supporting rod 220 are arranged rotationally, and only an effect of rotating within a predetermined range is achieved. Two extreme positions of the supporting rod 220 in a rotation are corresponding to an unfolding state and a storage state of the first supporting assembly 200 respectively. Therefore, during an actual usage, by adjusting a relative angle between the supporting rod 220 and the supporting base 210, the user can achieve an effect of storing the first supporting assembly 200 and storing the second supporting assembly 300 quickly, as well as facilitating to unfold and assemble quickly.

Figure 4:
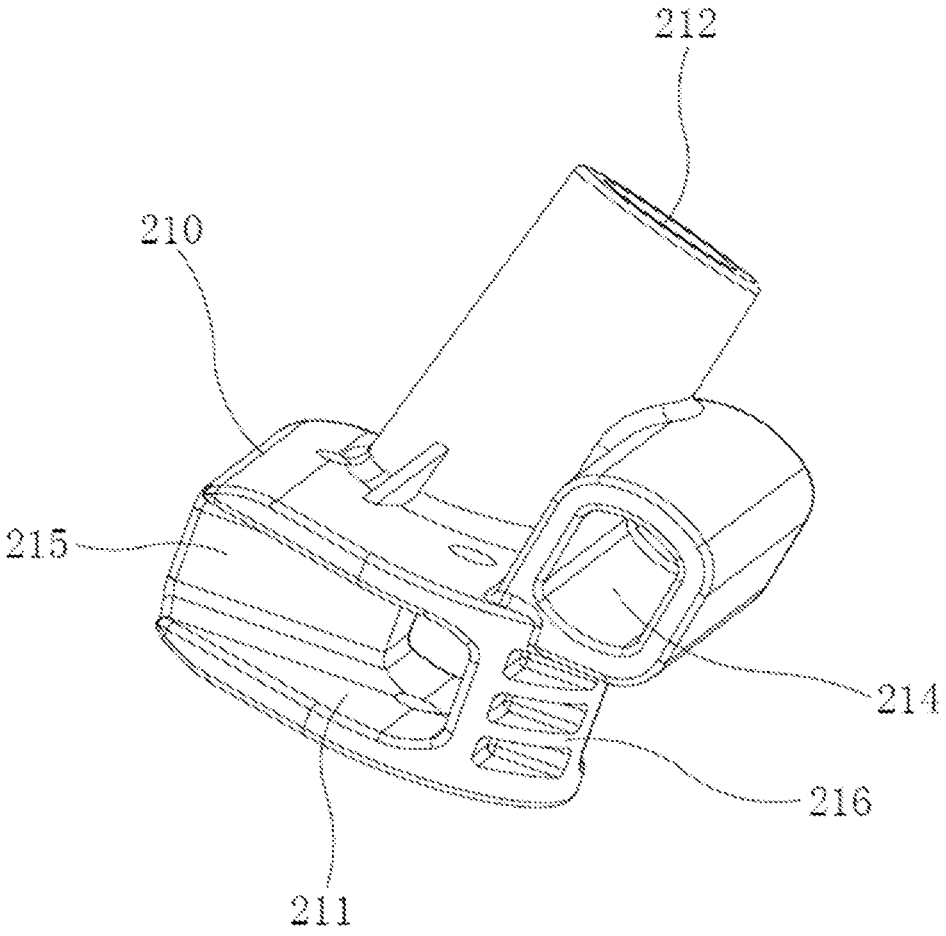
FIG. 4 illustrates a three-dimensional structural schematic diagram on the supporting base in the folding seat convenient to fold and store disclosed by the present application.

Specifically, as shown in FIG. 1 and FIG. 4, a limiting groove hole 211 is arranged in the supporting base 210, the limiting groove hole 211 penetrates through two ends of the supporting base 210. In an actual arrangement, the supporting rod 220 is sheathed on and arranged inside the limiting groove hole 211, and being limited in a certain movement space in the limiting groove hole 211. Specifically, the two sides of the supporting base 210 corresponding to the limiting groove hole 211 have a first limiting part 215 and a second limiting part 216 arranged inside respectively, the first limiting part 215 comprises two contact surfaces, and the second limiting part 216 also comprises two contact surfaces as a same, and the distance between the first limiting part 215 and the second limiting part 216 on a relative coordinate of both the X axis and the Y axis is adapting to the width distance of the supporting rod 220, that is, when in a limit position, a contact surface of the first limiting part 215 and a contact surface of the second limiting part 216 abut against two sides of the supporting rod 220, so as to achieve the effect of limiting; and when in another limit position, another contact surface of the first limiting part 215 and another contact surface of the second limiting part 216 abut against two sides of the supporting rod 220, so as to achieve the effect of limiting the supporting rod 220.

Figure 5:
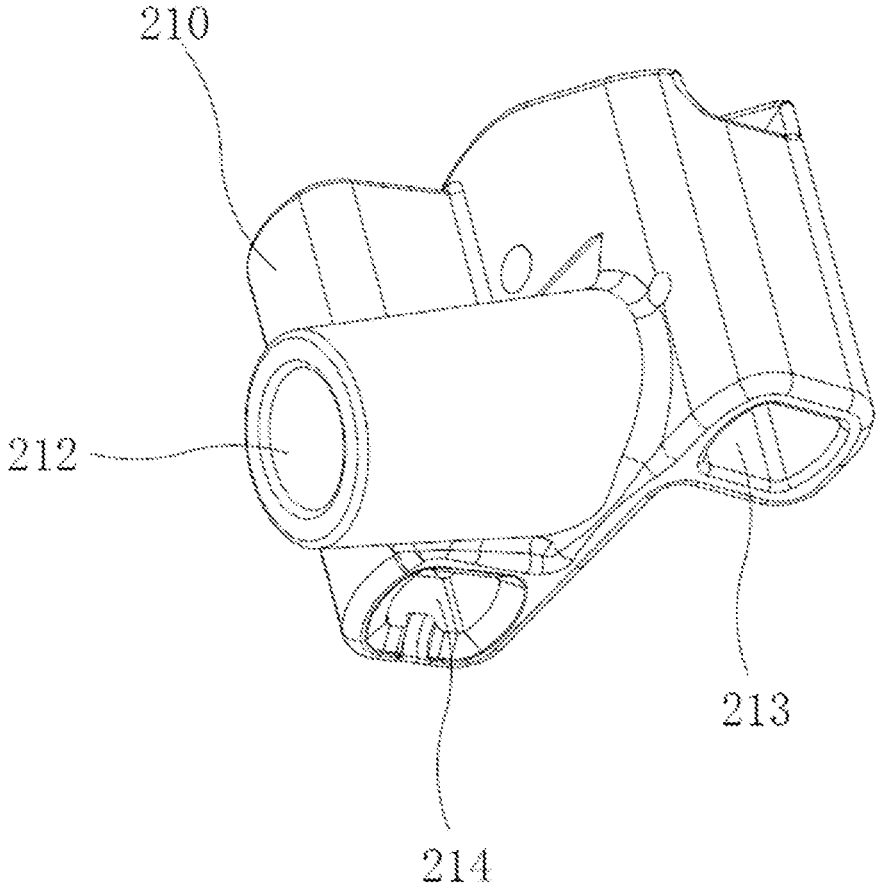
FIG. 5 illustrates a three-dimensional structural schematic diagram on a second viewing angle of the supporting base in the folding seat convenient to fold and store disclosed by the present application.

In another embodiment of the present application, shown as FIG. 1 and FIG. 5, one end of the supporting base 210 has a first mounting hole 213 arranged, and the first mounting hole 213 is located on the lower end of the supporting base 210 after the supporting base 210 is assembled. In order to achieve the effect of supporting the folding seat convenient to fold and store, in the present embodiment, the first supporting assembly 200 further comprises a foot rod 230, the foot rod 230 is detachably sheathed in the first mounting hole 213, and when the supporting rod 220 is in a unfolding limit state in the limiting groove hole 211, the foot rod 230 and the supporting rod 220 have a certain angle in between, so as to achieve a support to the supporting base 210, and the foot rod 230 and the lower end of the supporting rod 220 are locating in a same horizontal plane when in the unfolding limit state; when the supporting rod 220 is in a storing limit state in the limiting groove hole 211, as shown in FIG. 6, the foot rod 230 abuts against the supporting rod 220, the foot rod 230 is approximately parallel to the supporting rod 220, and in the storing limit state, the occupied space of the first supporting assembly 200 after storing can be reduced effectively.

Further, in order to ensure the support stability of the foot rod 230 and the supporting rod 220 in an unfolded state, the present embodiment further arranges a foot sheath 231 on the lower end of the foot rod 230 and the lower end of the supporting rod 220 respectively, and the foot sheath 231 is made of a rubber material, and a function thereof is to increase the friction between the foot rod 230, the supporting rod 220 and the ground on one aspect, and be able to provide a certain buffer effect for a vibration on another aspect, so as to ensure the users' comfort. The present embodiment, wherein due to the foot rod 230 and the supporting rod 220 in the unfolded state having a certain angle, to ensure contacting the ground, shown as FIG. 3, the present embodiment arranges preferably a side of the foot sheath 231 against the supporting rod 220 and the foot rod 230 in a hemispherical shape, an advantage of such an arrangement is ensuring a stable support while at a same time of enabling the foot sheath 231 to perform an autonomous adjustment according to an actual ground condition.

Another embodiment of the present application, shown as FIG. 1, FIG. 4 and FIG. 5, wherein another end of the supporting base 210 further has a second mounting hole 214 arranged, and the first supporting assembly 200 further comprises an arm rod 240, and the arm rod 240 is applied to supporting the chair pocket 100. In the present embodiment, the arm rod 240 is detachably arranged in the second mounting hole 214, and the arm rod 240 having been mounted corresponds to the upper end of the supporting rod 220, being able to achieve an effect of inserting into the chair pocket 100 to support the chair pocket 100. The present embodiment, wherein both the foot rod 230 and the arm rod 240 are arranged in the supporting base 210, in a real application, a force taken by the foot rod 230 and the arm rod 240 is transferred to the supporting base 210, and corresponding to each other, making the supporting base 210 act as a stressed body to maintain the effect of support.

Figure 6:
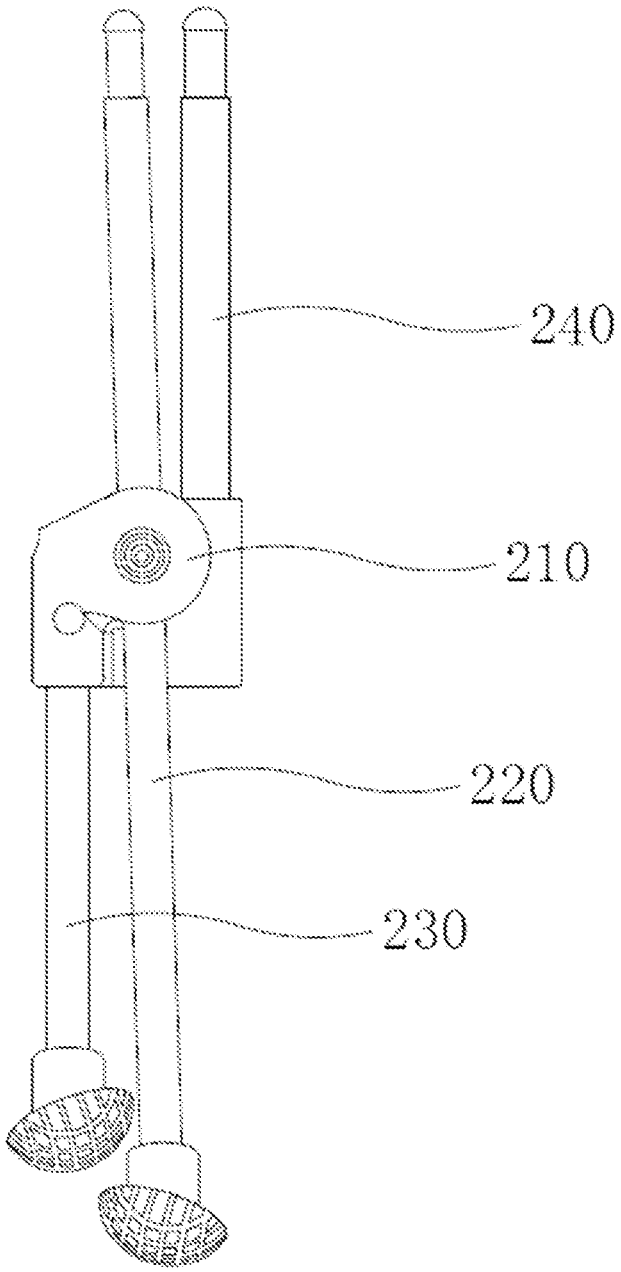
FIG. 6 illustrates a schematic diagram on a storage state of the first supporting assembly in the folding seat convenient to fold and store disclosed by the present application.

In a real application, when the supporting rod 220 is in a unfolding limit state in the limiting groove hole 211, the arm rod 240 and the supporting rod 220 are forming a certain angle, so as to support the chair pocket 100 and a user on the chair pocket 100; when the supporting rod 220 is in a storing limit state in the limiting groove hole 211, shown as FIG. 6, the arm rod 240 is approximately parallel to the supporting rod 220, and in such a state, the occupied space of the first supporting assembly 200 after storing can be effectively reduced.

Figure 3:
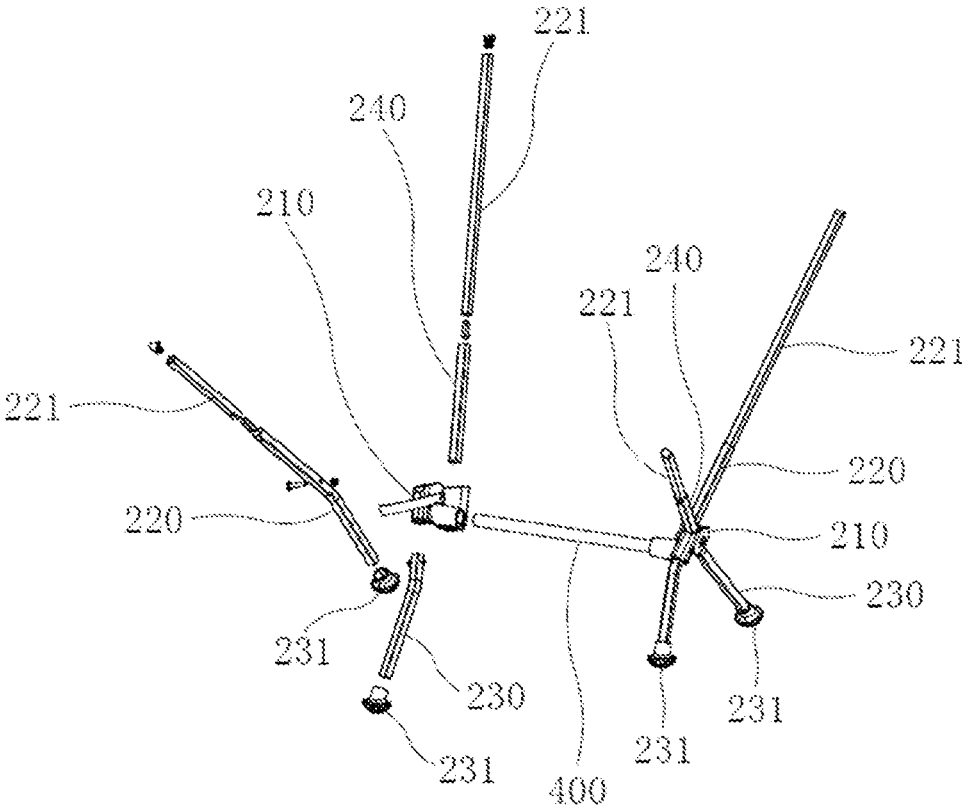
FIG. 3 illustrates a schematic structural diagram on the first supporting assembly and the second supporting assembly in the folding seat convenient to fold and store disclosed by the present application.

Based on the embodiments stated above, another embodiment in the present application shown as FIG. 1 and FIG. 3, the folding seat has a certain degree of inclination angle, is able to support a user having a sitting posture in an inclined state, so in the present application an end position of the upper end of the arm rod 240 and an end position of the upper end of the supporting rod 220 corresponding to each other has a telescopic rod arranged respectively, the telescopic rod 221 arranged on the arm rod 240 accordingly is connected slidably to the arm rod 240, being able to achieve the effect of being stored in the arm rod 240 or being extended from the upper end of the arm rod 240; accordingly, the telescopic rod 221 arranged on the supporting rod 220 is arranged in a sliding mode with the supporting rod 220, being able to achieve the effect of being stored in the supporting rod 220 or being extended from the supporting rod 220.

The embodiment stated above, wherein when the first supporting assembly 200 is in a storing state, the telescopic rod 221 on the arm rod 240 can be stored inside the arm rod 240, so as to achieve the effect of reducing a storage space. The telescopic rod 221 on the supporting rod 220 can be stored inside the supporting rod 220, so as to achieve the effect of reducing the storage space. Meanwhile, since the length size of the arm rod 240 and the length size of the supporting rod 220 are different, the length size of the telescopic rod 221 in the arm rod 240 and the length size of the telescopic rod 221 in the supporting rod 220 are different, thus the effect of inclined support to the chair pocket 100 can be achieved. When the first supporting assembly 200 is in an unfolding state, the chair pocket 100 can be supported to an inclined state to ensure the comfort when a user is sitting or lying.

Further, in the embodiment stated above, the fixation in the unfolded state between the telescopic rod 221 and the arm rod 240, between the telescopic rod 221 and the supporting rod 220, is achieved by means of clamping, in an embodiment of the present application, it is possible to arrange a compression spring inside the telescopic rod 221, and arrange a positioning column on one side of the compression spring, as well as arranging a positioning hole adapting to the size of the positioning column on the telescopic rod 221 and the arm rod 240 (or the supporting rod 220). By means of the pressure of the compression spring, the positioning column penetrates through the positioning holes in the telescopic rod 221 and the arm rod 240 (or the supporting rod 220), so as to achieve the effect of fixing the relative position. In a plurality of other embodiments of the present application, it is possible to achieve fixation by means of a bolt, a plug, and more, which is not limited in the present application.

In another embodiment of the present application, shown as FIG. 1 and FIG. 3, since the first supporting assembly 200 and the second supporting assembly 300 are connected detachably, and in order to ensure the support stability, a certain distance should be kept between the first supporting assembly 200 and the second supporting assembly 300; thus the present embodiment further arranges a middle transverse pipe 400 between the first supporting assembly 200 and the second supporting assembly 300, accordingly, a pipe sheath 212 is arranged on the supporting base 210, and the pipe sheath 212 arranged on the supporting base 210 in the first supporting assembly 200 is arranged corresponding to the pipe sheath 212 arranged on the supporting base 210 in the second supporting assembly 300, and both ends of the middle transverse pipe 400 are connected with the two pipe sheaths 212 in a sheathing mode respectively, so as to achieve the fixation to the first supporting assembly 200 and the second supporting assembly 300. The present embodiment, wherein in order to ensure a relative angle between the first supporting assembly 200 and the second supporting assembly 300, it is possible to arrange a cross section of the middle transverse pipe 400 to be a waist circle style or a rectangular style, so as to avoid the situation of the angle between the first supporting assembly 200 and the second supporting assembly 300 not corresponding after having been assembled.

Figure 2:
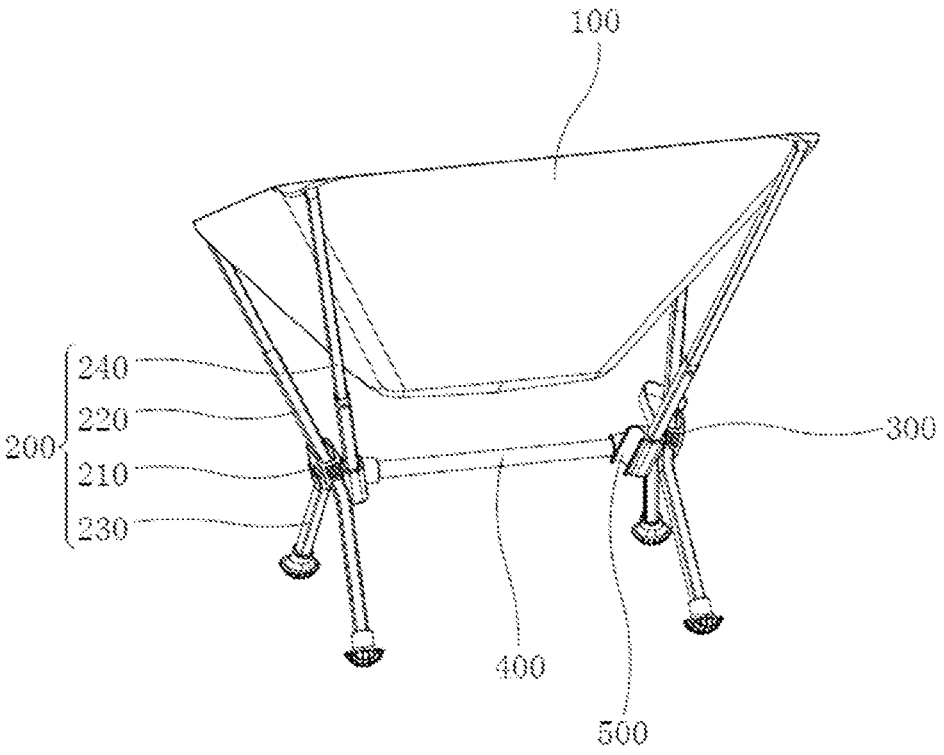
FIG. 2 illustrates a three-dimensional structural schematic diagram on a rear view of the folding seat convenient to fold and store disclosed by the present application.

Further, as shown in FIG. 2, in order to achieve the effect of storing the middle transverse pipe 400 in the same way after storing the first supporting assembly 200 and the second supporting assembly 300, the present embodiment further arranges a clamping base 500 on the supporting base 210, the inner shape of the clamping base 500 adapts to the shape of the cross section of the middle transverse pipe 400, and the clamping base 500 is preferred to be set in a C shape and made by adopting a material having a certain elasticity, when storing the folding seat in a whole, the middle transverse pipe 400 can be inserted inside the clamping base 500, so as to achieve the effect of fixing and storing, and avoid the situation that the middle transverse pipe 400 is lost after storing.

Another embodiment of the present application, wherein shown as FIG. 1, since when in a storage state, the first supporting assembly 200 and the second supporting assembly 300 are in a mutually separated state, that will bring the user the inconvenience of storing and placing, therefore, the present embodiment further arranges a strap 600 on the supporting base 210, the strap 600 is applied to binding the first supporting assembly 200 and the second supporting assembly 300 when in a storage state, so as to fix the first supporting assembly 200 and the second supporting assembly 300, thereby facilitating the user to move or to place.

Based on the embodiments stated above, an actual storage process of the folding seat convenient to fold and store is as follows:

shown as FIG. 1, FIG. 1 illustrates a using state of the folding seat convenient to fold and store, when it is needed to be stored, the chair pocket 100 is first removed from the first supporting assembly 200 and the second supporting assembly 300, then the first supporting assembly 200 and the second supporting assembly 300 are separated, and the middle transverse pipe 400 applied to connecting the first supporting assembly 200 and the second supporting assembly 300 is then clamped on the clamping base 500 in the supporting base 210, followed by rotating the supporting rod 220 on the first supporting assembly 200 in a direction set by the limiting groove hole 211, to a state shown in FIG. 6, and performing the same operation to the supporting rod 220 on the second supporting assembly 300 to the state shown in FIG. 6, and finally bounding the first supporting assembly 200 and the second supporting assembly 300 together by the strap 600 arranged on the supporting base 210, to achieve the fixation. Therefore, the folding seat convenient to fold and store is stored.

All above, the present application provides a folding seat which is convenient to fold and store. The folding seat comprises a chair pocket; a first supporting assembly, the first supporting assembly comprises a supporting base and a supporting rod, while the supporting rod is hinged to the interior of the supporting base and can rotate in a preset range; and a second supporting assembly, the second supporting assembly has the same structure as and being arranged opposite of the first supporting assembly, the second supporting assembly is detachably connected with the first supporting assembly, and the chair pocket is arranged and sheathed on the first supporting assembly and the second supporting assembly. By arranging the first supporting assembly and the second supporting assembly which are detachable, to support the chair pocket, the present application achieves the fixation to the folding seat; when the folding seat needs to be stored, after the first supporting assembly and the second supporting assembly are disassembled, a rotational adjustment is applied to the supporting rods in the first supporting assembly and the second supporting assembly respectively, to achieve folding and storing. Comparing with the prior art, the time for storing or assembling can be simplified, and users' operation can be facilitated.

It should be understood that, the application of the present application is not limited to the above examples listed. Skilled in the art can improve or change the applications according to the above descriptions, all of these improvements and transforms should belong to the scope of protection in the appended claims of the present application.

What is claimed is:

1. A folding seat, wherein comprising:

a chair pocket;

a first supporting assembly comprising a supporting base and a supporting rod, the supporting rod is hinged to an interior of the supporting base and rotates in a preset range; wherein one end of the supporting base has a first mounting hole arranged, a foot rod is detachably sheathed in the first mounting hole, the foot rod corresponds to a lower end of the supporting rod, and when the supporting rod is rotated to a storage state, the supporting rod abuts against the foot rod;

a second supporting assembly having a same structure as the first supporting assembly, and being arranged opposite of the first supporting assembly, the second supporting assembly is detachably connected with the first supporting assembly, and the chair pocket is sheathed on the first supporting assembly and the second supporting assembly.

2. The folding seat according to claim 1, wherein the supporting base has a strap arranged, and the strap is configured to fix the first supporting assembly and the second supporting assembly having been stored.

3. The folding seat according to claim 1, wherein an end position of the lower end of the foot rod and an end position of the lower end of the supporting rod corresponding to each other have a foot sheath arranged respectively, the foot sheath is connected fixedly with the foot rod and the supporting rod respectively, and a side of the foot sheath deviating from the supporting rod or the foot rod is hemispherical.

4. The folding seat according to claim 1, wherein another end of the supporting base has a second mounting hole arranged, an arm rod is detachably sheathed in the second mounting hole, the arm rod corresponds to an upper end of the supporting rod, and the arm rod and the foot rod are arranged along a same direction.

5. The folding seat according to claim 4, wherein an end position of the upper end of the arm rod and an end position of the upper end of the supporting rod corresponding to each other has a telescopic rod arranged respectively, the telescopic rod is slidably connected with the arm rod and the supporting rod in a sheathing mode respectively, and the telescopic rod is elastically clamped and fixed.

6. The folding seat according to claim 1, wherein the supporting base has a limiting groove hole arranged, the limiting groove hole penetrates through two ends of the supporting base, and the first supporting rod is hinged to a central part of the limiting groove hole.

7. The folding seat according to claim 6, wherein two sides of the supporting base corresponding to the limiting groove hole have a first limiting part and a second limiting part arranged respectively, and the first limiting part and the second limiting part are configured to limit a rotating range of the supporting rod.

8. The folding seat according to claim 1, wherein a middle transverse pipe is arranged between the first supporting assembly and the second supporting assembly;

the supporting base has a pipe sheath arranged, and two ends of the middle transverse pipe are detachably arranged in the pipe sheath of the supporting base in the first supporting assembly and the second supporting assembly respectively;

the supporting base has a clamping base arranged, an inner shape of the clamping base matches with a cross-sectional shape of the middle transverse pipe, and the clamping base is configured to fix the middle transverse pipe having been disassembled.

* * * * *